US007500887B2

(12) United States Patent
Ichio

(10) Patent No.: US 7,500,887 B2
(45) Date of Patent: Mar. 10, 2009

(54) CONNECTOR AND METHOD OF ASSEMBLING IT

(75) Inventor: Toshifumi Ichio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 40 days.

(21) Appl. No.: 11/879,899

(22) Filed: Jul. 19, 2007

(65) Prior Publication Data

US 2008/0020639 A1 Jan. 24, 2008

(30) Foreign Application Priority Data

Jul. 20, 2006 (JP) ..... 2006-198137

(51) Int. Cl.
*H01R 13/514* (2006.01)

(52) U.S. Cl. ..... 439/752; 439/595

(58) Field of Classification Search ..... 439/271, 439/275, 595, 752

See application file for complete search history.

(56) References Cited

U.S. PATENT DOCUMENTS 5,879,201 A * 3/1999 Fukamachi et al. ..... 439/752
6,135,824 A 10/2000 Okabe et al.
6,264,497 B1 * 7/2001 Murakami et al. ..... 439/417
6,358,102 B1 * 3/2002 Fukamachi ..... 439/752
6,450,823 B1 * 9/2002 Ichio et al. ..... 439/275
6,902,443 B2 * 6/2005 Hara et al. ..... 439/752
2003/0096539 A1 * 5/2003 Ichio ..... 439/752
2008/0020639 A1 * 1/2008 Ichio ..... 439/595

FOREIGN PATENT DOCUMENTS

JP 10-92501 4/1998

* cited by examiner

*Primary Examiner*—James Harvey
(74) *Attorney, Agent, or Firm*—Gerald E. Hespos; Anthony J. Casella

(57) ABSTRACT

A connector housing assembly (10) is formed by assembling a first housing (11) and a second housing (40) individually formed by molds that are opened in forward and backward directions, and an accommodation space (70) for accommodating a retainer (60) is defined between the first housing (11) and the second housing (40). It is sufficient for the molds for forming the connector housing assembly (10) to include only the molds that are opened in forward and backward directions to form the two housings (11, 40), and a mold that is opened in a direction normal to forward and backward directions is not necessary. Thus, space required for the molds for forming the connector housing assembly (10) can be small.

12 Claims, 18 Drawing Sheets

CONNECTOR AND METHOD OF ASSEMBLING IT

BACKGROUND OF THE INVENTION

1. Field of the Invention

The invention relates to a connector provided with a retainer and to a method of assembling it.

2. Description of the Related Art

Japanese Unexamined Patent Publication No. H10-92501 discloses a connector with a housing made from a synthetic resin. Cavities penetrate the housing in forward and backward directions, and terminal fittings are inserted into the cavities from behind. A retainer can be mounted in the housing in a direction normal to an inserting direction of the terminal fittings and is configured to retain the terminal fittings.

The above-described housing is formed with molds that are opened in the forward and backward directions of the cavities and a slide core that is opened along the mounting direction of the retainer. Thus, the opening direction of the slide core is normal to the opening direction of molds for forming the cavities, and a large space is required to open the molds. The number of housings that can be formed at the same time will be decreased further if there is a restriction on the insulation space of the molds.

The invention was developed in view of the above situation, and an object thereof is to reduce the space necessary to open molds for forming a housing.

SUMMARY OF THE INVENTION

The invention relates to a connector with a housing assembly made of synthetic resin. At least one cavity penetrates the housing assembly in substantially forward and backward directions, and at least one terminal fitting can be inserted into the cavity in an inserting direction. The connector further has a retainer mounted into the housing assembly along a mounting direction and at an angle to the inserting direction of the terminal fitting. The retainer is configured to retain the inserted terminal fitting in the cavity. The housing assembly includes first and second housings that are formed individually by molds that are opened in forward and backward directions. An accommodation space for the retainer is defined between the housings when the housings assembled with each other. As a result, the housing assembly is formed entirely by molds that are opened in forward and backward directions, and a mold that is opened in a direction normal to the forward and backward directions is unnecessary. Thus, a smaller space is needed to open the molds.

The first housing preferably has an accommodation recess for accommodating the second housing and the retainer.

The accommodation recess preferably defines an end opening and a retainer mount opening. The end opening is formed in either a front or rear end of the first housing for accommodating the second housing. The retainer mount opening is formed in an outer side surface at an angle to the end of the first housing to mount the retainer.

A finger placing portion preferably is defined on the first housing between opening edges of the end opening and the retainer mount opening and is configured to accommodate fingers.

The inner surface of the finger placing portion that faces the end opening preferably is substantially flush with an imaginary plane defined by extending the outer side surface that has the retainer mount opening. As a result, a mold that is opened along the outer side surface formed that has the retainer mount opening and the mold that is opened along the inner surface of the finger placing portion facing the end opening can be constructed to slide against each other. Thus, the accommodation recess, the finger placing portion and the retainer mount opening can be formed only by the molds that are opened in forward and backward directions.

A part of the second housing preferably is exposed at a retainer mount opening when the second housing is mounted in the accommodation recess. With this construction, the second housing might be displaced towards the retainer mount opening. Accordingly, at least one of the housings preferably is formed with at least one lock for preventing a displacement of the second housing towards the retainer mount opening.

The invention also relates a method of assembling or forming a connector, such as the above-described connector. The method comprises providing first and second housings individually formed by molds that are opened in forward and backward directions, assembling the housings with each other to define an accommodation space, and accommodating a retainer in the accommodation space between the housings in a mounting direction at an angle to the forward and backward directions.

The method may further comprise providing the first housing with at least one accommodation recess and at least partly accommodating the second housing in the accommodation recess.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
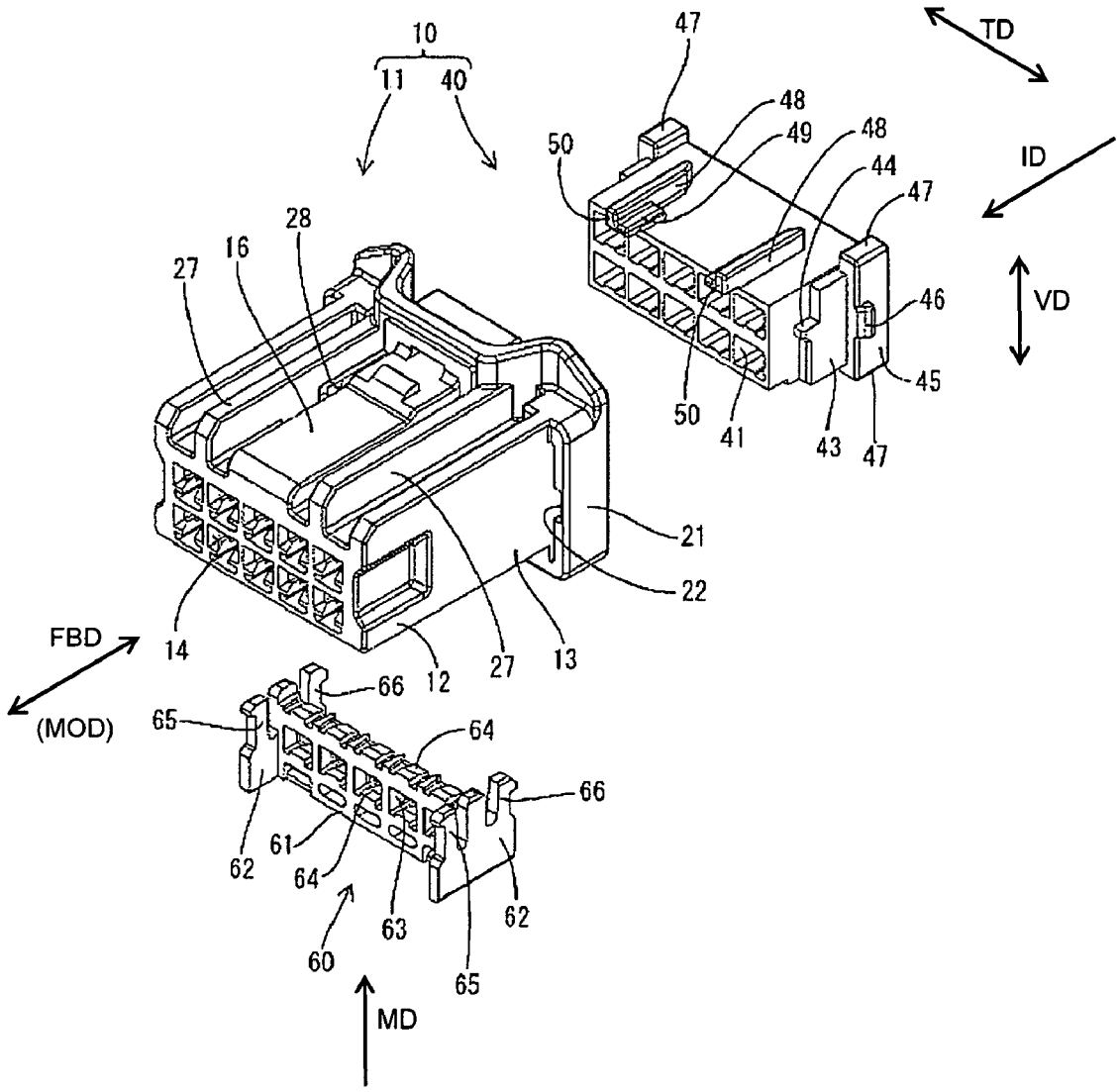
FIG. 1 is an exploded perspective view of one embodiment when viewed from front.
Figure 2:
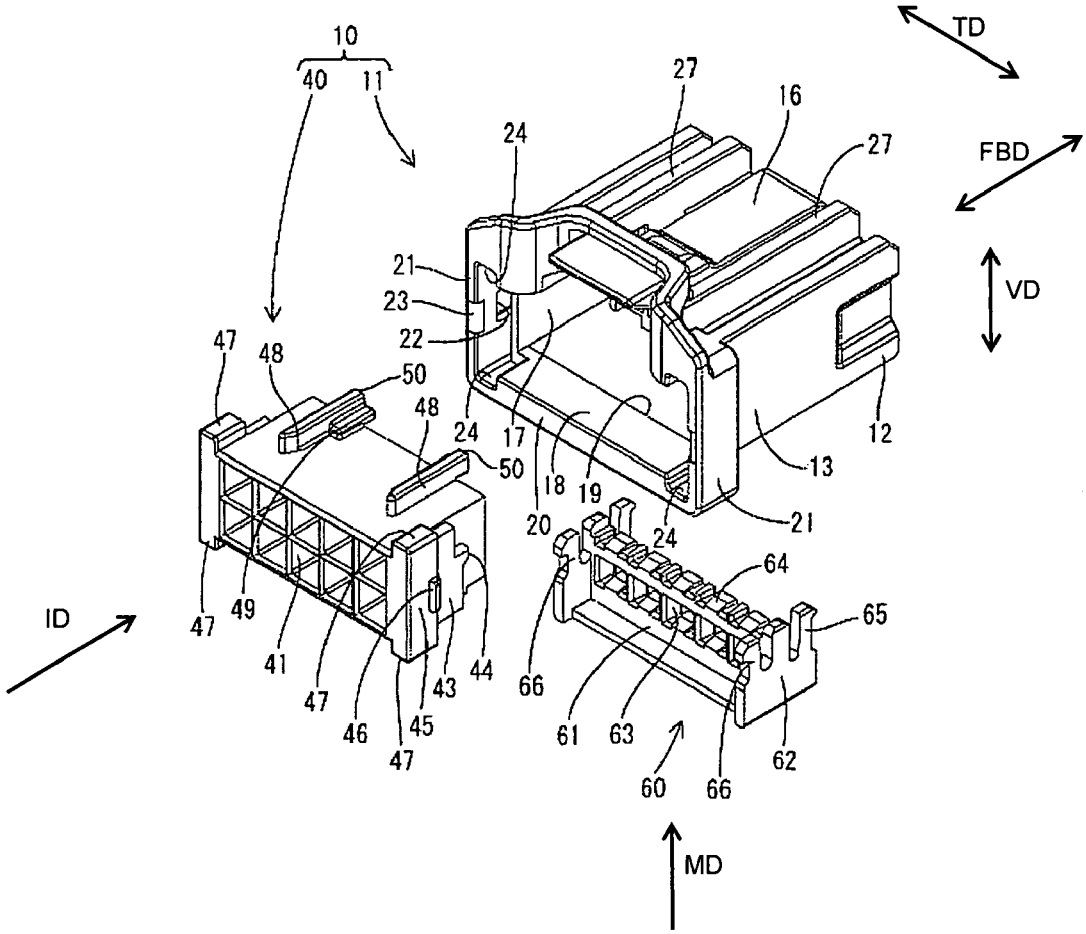
FIG. 2 is an exploded perspective view of the embodiment when viewed from behind.

A connector according to the invention is described with reference to FIGS. 1 to 18. The connector has a first housing 11, a second housing 40, a retainer 60 and terminal fittings 80.

In the following description, a connection end with an unillustrated mating connector is referred to as the front end along forward and backward directions FBD.

The first housing 11 is made unitarily e.g. of a synthetic resin and includes a block-shaped terminal accommodating portion 12 and a rectangular tubular receptacle 13 that extends back from the terminal accommodating portion 12. Front cavities 14 penetrate the terminal accommodating portion 12 from the front end to the rear end while being arrayed in a vertical direction VD and transverse direction TD. A lock 15 is cantilevered forward along a bottom wall in each front cavity 14. Each lock 15 is resiliently deformable along the vertical direction VD, which is substantially normal to an inserting direction ID of the terminal fittings 80 into the front cavities 14. The front cavities 14 are open at both the front and rear ends. Thus, the insides of the front cavities 14 including the locks 15 are formed by molds that open in forward and backward directions. A lock arm 16 cantilevers rearwardly along the upper outer surface of the terminal accommodating portion 12 and has a front end supported by a leg at the front end of the upper surface of the terminal accommodating portion 12. Thus, the lock arm 16 is resiliently deformable up and down normal to the forward and backward directions FBD with the leg as a support.

The inside of the receptacle 13 serves as an accommodation space 17 for accommodating part of the second housing 40 and the retainer 60. The accommodation recess 17 has a substantially rectangular end opening 18 that extends across substantially the entire rear end of the first housing 11, and hence the rear end of the receptacle 13. The accommodation recess 17 also has a retainer mount opening 19 that extends across substantially the entire bottom surface of the first housing 11, which is the outer surface aligned substantially normal to the rear end of the first housing 11. The end opening 18 is configured to mount the second housing 40 into the accommodation recess 17, and the retainer mount opening 19 is configured to mount the retainer 60 into the accommodation recess 17.

A finger placing portion 20 extends in the transverse direction between the bottom of the end opening 18 and the rear end of the retainer mount opening 19. Thus, the finger placing portion 20 is arranged at the bottom rear of the receptacle 13 and connects the left and right walls of the receptacle 13. The finger placing portion 20 projects out and down from the bottom of the first housing 11 to define a step formed by the molds that are opened in forward and backward directions FBD. The inner upper surface of the finger placing portion 20 faces into the end opening 18 and is substantially coplanar with the outer surface of the first housing 11 that is forward of the retainer mount opening 19. Accordingly, the molds used to form the finger placing portion 20 include a mold that is opened forward along the surface of the terminal accommodating portion 12 of the first housing 11 that has the retainer mount opening 19 and a mold that is opened backward along the inner surface of the finger placing portion 20 that faces into the end opening 18. Accordingly, the retainer mount opening 19 opens substantially normal to the mold opening directions MOD and is formed by sliding these two molds against each other.

Bulges 21 bulge out in the transverse direction TD at the rear ends of the opposite left and right side walls of the receptacle 13 to form steps. The bottom ends of the left and right bulges 21 are connected with the respective opposite left and right ends of the finger placing portion 20. The inner surfaces of the bulges 21 are retracted out in the transverse direction TD from the inner surfaces of the corresponding side walls to form steps, and receiving portions 22 are formed at intermediate positions of the inner surfaces of the bulges 21 in the vertical direction VD. Guiding slants 23 are formed at the rear end edges of the bulges 21, and are at substantially the same height as the receiving portions 22. The bulges 21, including the receiving portions 22, bulge out more than the side walls of the receptacle 13, and hence are formed by the molds that open in forward and backward directions FBD.

The upper and lower walls of the rear end of the receptacle 13 are recessed outwardly (down and up) at the opposite left and right ends to form a total of four fitting recesses 24 in the accommodation recess 17 and open in the rear end surface of the receptacle 13. The fitting recesses 24 are substantially flush with and continuous with the inner surfaces of the bulges 21. Locking grooves 25 are made in the opposite left and right edges of the rear end surface of the bottom surface of the terminal accommodating portion 12. Full locking projections 26 are formed at the back end edges of the locking grooves 25.

Protection walls 27 are formed on the upper surface of the first housing 11 at opposite sides of the lock arm 16 and extend from the terminal accommodating portion 12 to the rear end of the receptacle 13. An area of the upper wall of the receptacle 13 between the protection walls 27 is open and communicates with the accommodation recess 17 near parts of the protection walls 27 corresponding to the receptacle 13. Accordingly, a rear end of the lock arm 16 faces the accommodation recess 17. Guide grooves 28 are formed at inner surfaces of the protection walls 27 and extend from the rear ends of the protection walls 27 towards the front end of the receptacle 13. The guide grooves 28 communicate with the accommodation recess 17 located therebelow in areas excluding back end portions. A partition wall 29 is defined at the back end of each guide groove 28 and a locking recess 30 is defined above each partition wall 29. Thus, the partition wall 29 partitions the locking recess 30 from the accommodation recess 17. Locking surfaces are defined in the locking recesses 30. The guide grooves 28 and the locking recesses 30 open backward, and are formed by the mold that is opened backward.

The second housing 40 is made e.g. of a synthetic resin and is in the form of a block. Rear cavities 41 open in both front and rear end surfaces of the second housing 40 and are arrayed in the vertical direction VD and the transverse direction TD at upper and lower stages. The rear cavities 41 are arranged to correspond to the respective front cavities 14, and the corresponding pairs of the front cavities 14 and the rear cavities 41 form cavities 42 that extend in forward and backward directions FBD, while being disconnected at intermediate parts Left and right first steps 43 bulge out at intermediate parts of the left and right surfaces of the second housing 40 with respect to forward and backward directions FBD, and partial locking projections 44 are formed at the front end edges of the first steps 43. Similarly, left and right second steps 45 are formed at the rear ends of the left and right surfaces of the second housing 40 and bulge out more than the respective first steps 43. Retaining projections 46 project laterally out near the front end edges of the second steps 45. Fitting projections 47 project from the upper and lower ends of the second steps 45 beyond the respective upper and lower upper surfaces of the second housing 40.

Left and right guide ribs 48 are formed on the upper surface of the second housing 40 and extend substantially in forward and backward directions FBD. The rear ends of the guide ribs 48 are located before the rear end edge of the second housing 40 and the front ends thereof project more forward than the front end surface of the second housing 40. Reinforcing ribs 49 are formed on the upper surface of the second housing 40 and extend substantially parallel to the guide ribs 48. The reinforcing ribs 49 are shorter than the guide ribs 48 and are connected with the inner surfaces of the guide ribs 48. Accordingly, the reinforcing ribs 49 improve the rigidity of front portions of the guide ribs 48. Locking projections 50 are defined by the front parts of the guide ribs 48 and reinforcing ribs 49 that project forward from the front end surface of the second housing 40. Each locking projection 50 has a substantially L-shaped cross section.

The rear cavities 41 penetrate the second housing 40 in forward and backward directions FBD. The guide ribs 48 and reinforcing ribs 49 similarly extend straight in forward and backward directions FBD. The first and steps 43 and 45 bulge laterally out substantially normal to the forward and backward directions FBD. Similarly, the partial locking projections 44 and retaining projections 46 project laterally out substantially normal to the forward and backward directions FBD. Thus, the second housing 40 is formed by the molds that are opened in forward and backward directions FBD.

The retainer 60 is formed from a synthetic resin and includes a main body 61 that is narrow and long in the transverse direction TD. Side plates 62 are formed at the opposite left and right ends of the main body 61. Through holes 63 penetrate the main body 61 in forward and backward directions FBD at positions corresponding to the cavities 42 at the lower stage, and secondary locks 64 are formed on the bottoms of the inner walls of the respective through holes 63. Secondary locks 64 are formed on the upper surface of the main body 61 at positions corresponding to the cavities 42 at the upper stage.

The side plates 62 are substantially parallel to forward and backward directions FBD and vertical direction VD. Resilient pieces 65 for full locking are cantilevered up at positions of the side plates before the main body 61. On the other hand, resilient pieces 66 for partial locking are cantilevered up at positions of the side plates behind the main body 61. The resilient pieces 65 and 66 for full and partial locking are both resiliently deformable in forward and backward directions FBD.

The second housing 40 can be inserted into the accommodation recess 17 of the first housing 11 through the end opening 18. Upon starting the insertion, the front ends of the guide ribs 48 and reinforcing ribs 49 enter the respective guide grooves 28 and the bottom surface of the second housing 40 starts sliding on the upper surface of the finger placing portion 20. Thus, the second housing 40 is positioned with respect to the first housing 11 in the vertical direction VD. Further, the guide ribs 48 slide in contact with the inner side surfaces of the guide grooves 28 to position the second housing 40 with respect to the first housing 11 in the transverse direction TD.

The locking projections 50 defined by the front end portions of the guide ribs 48 and reinforcing ribs 49 fit into the locking recesses 30 when the second housing 40 reaches a proper assembled position, and prevent the front end of the second housing 40 from moving vertically and transversely relative to the first housing 11. Further, the outer side surfaces of the second steps 45 contact the inner surfaces of the bulges 21 to prevent the rear end of the second housing 40 from moving vertically and transversely relative to the first housing 11. Furthermore, the retaining projections 46 engage the receiving portions 22 to prevent the second housing 40 from moving a backward in a separating direction from the first housing 11. Further, the front ends of the locking projections 50 contact the back end surfaces of the locking recesses 30 to stop the second housing 40 at its front end position. Thus, the second housing 40 is locked and assembled into the first housing 11 to form the connector housing 10.

The first steps 43 are located along the inner surfaces of the side walls of the receptacle 13 and the partial locking projections 44 of the first steps 43 are behind the full locking projections 26 when the housings 11, 40 are assembled together. Further, the four fitting projections 47 are fit into the corresponding fitting recesses 24, and most of the bottom surface of the second housing 40, excluding the rear end thereof, is exposed at the bottom surface of the first housing 11 through the retainer mount opening 19. An accommodation space 70 is defined in the accommodation recess 17 between the rear end of the terminal accommodating portion 12 and the front end of the second housing 40. The accommodation space 70 communicates with areas outside and below the first housing 11 via the retainer mount opening 19 and can accommodate the retainer 60. The locking grooves 25 in the terminal accommodating portion 12 communicate with the accommodation space 70. Slits 71 defined between areas of the outer side surfaces of the second housing 40 before the first step 43 and the inner surfaces of the side walls of the receptacle 13 also communicate with the accommodation space 70. The slits 71 are located to face the locking grooves 25 from behind, and the partial locking projections 44 are located in the slits 71. Similar to the accommodation space 70, the locking grooves 25 and the slits 71 are exposed to the outside and below the first housing 11 via the retainer mount opening 19.

Figure 6:
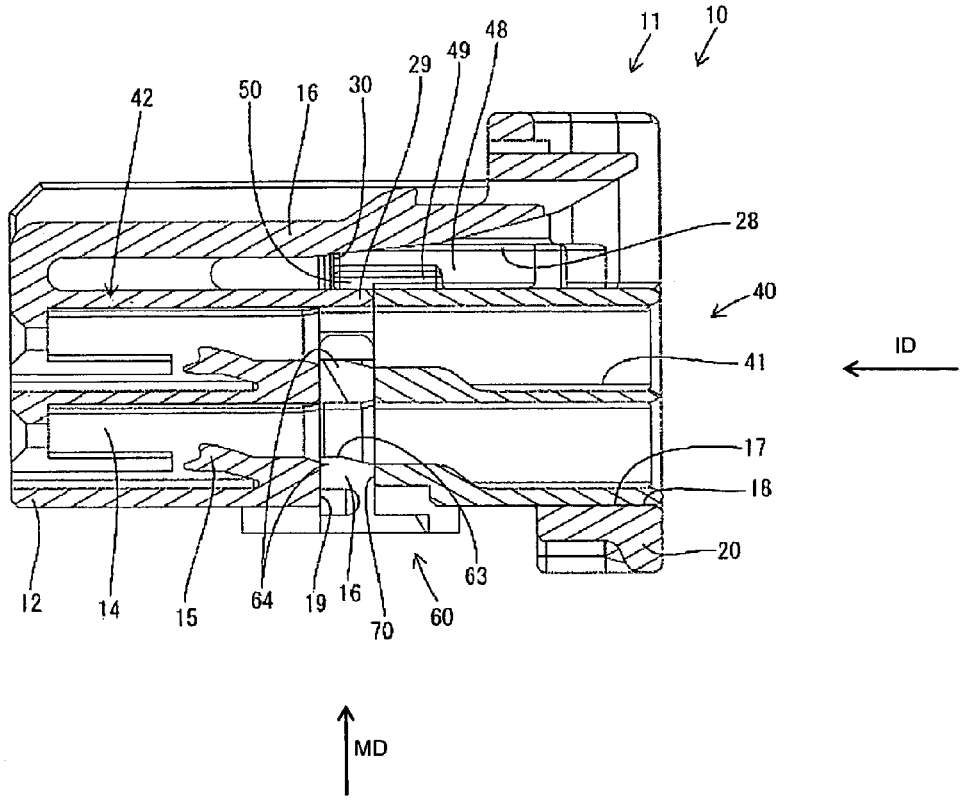
FIG. 6 is a longitudinal section showing a state where a retainer is mounted at a partial locking position in the connector housing.
Figure 7:
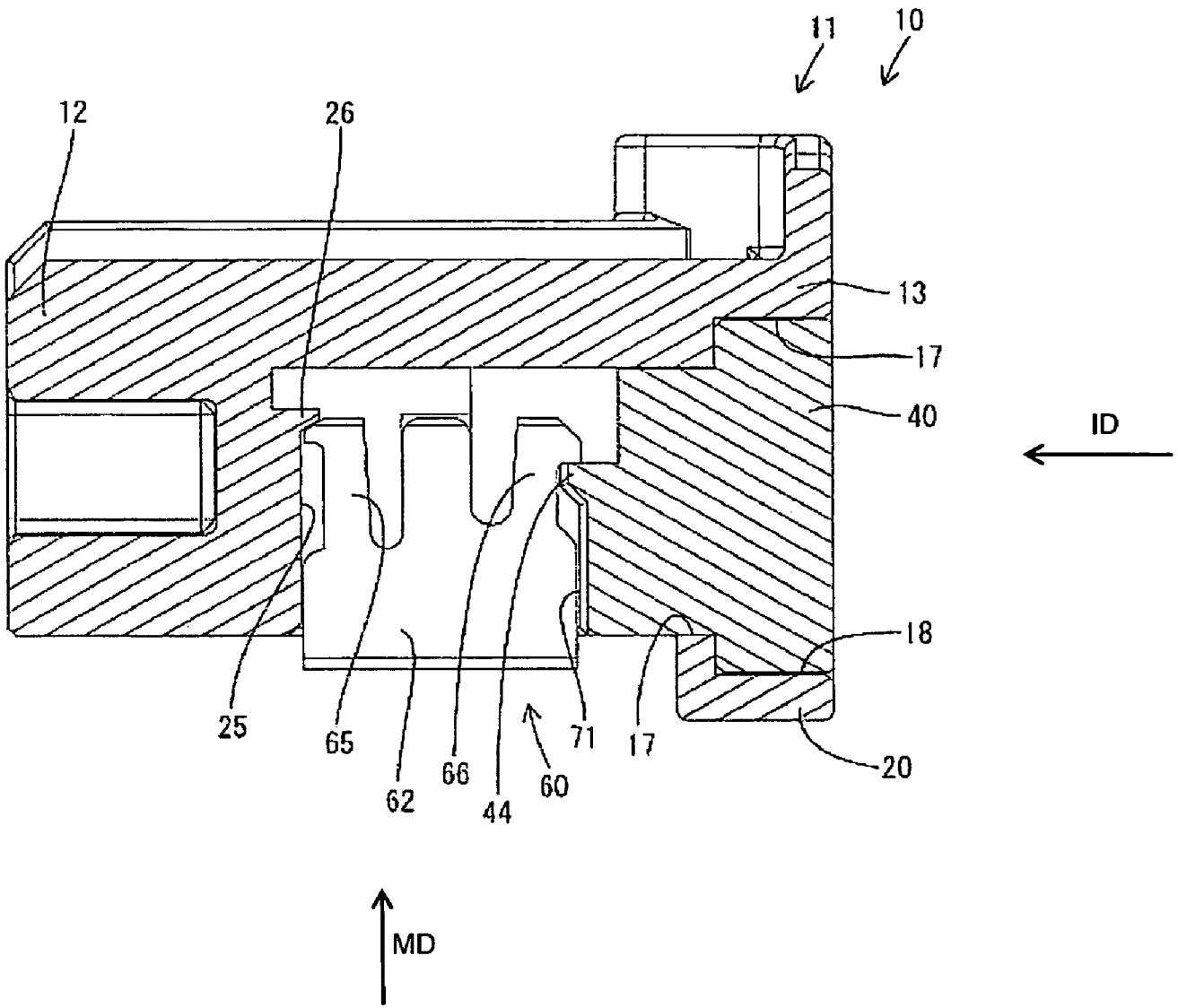
FIG. 7 is a longitudinal section showing locking means for holding the retainer at the partial locking position.
Figure 8:
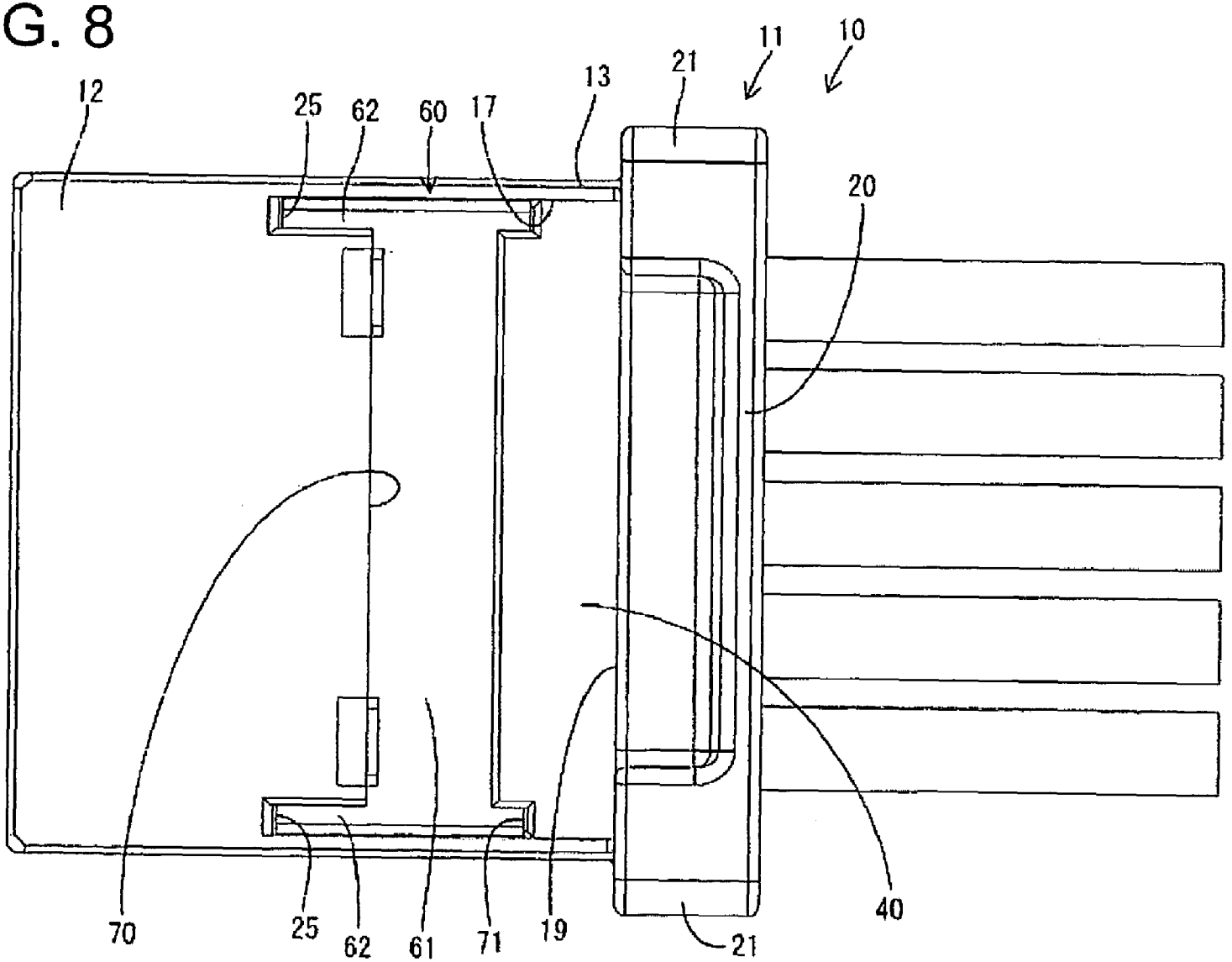
FIG. 8 is a bottom view showing a state where the retainer and terminal fittings are mounted in the connector housing.

The retainer 60 is mounted into the connector housing 10 along the mounting direction MD, which substantially normal to the inserting direction ID. More particularly, the main body 61 of the retainer 60 is inserted into the accommodation space 70 through the retainer mount opening 19 and the side plates 62 are inserted into the respective locking grooves 25 and the slit-shaped spaces 71 through the retainer mount opening 19. Then, as shown in FIG. 7, claws at the leading ends of the resilient pieces 65 for full locking contact the full locking projections 26 and claws at the leading ends of the resilient pieces 66 for partial locking engage the partial locking projections 44 from above. As a result, the retainer 60 is held at a partial locking position. In this state, as shown in FIG. 6, the through holes 63 are located at positions substantially corresponding to the cavities 42 at the lower stage and the upper surface of the main body 61 is located at substantially the same height as the bottom walls of the cavities 42 at the upper stage. In this state, the terminal fittings 80 can be inserted into the cavities 42.

The terminal fittings 80 are inserted in the inserting direction ID into the connector housing 10. More particularly, each terminal fitting 80 is inserted into the rear cavity 41 from behind and along the inserting direction ID, and further is inserted through the accommodation space 70 and into the front cavity 14. The terminal fitting 80 preferably is a female terminal fitting with a substantially rectangular tube 81 at the front end. The lock 15 in the front cavity 14 engages the terminal fitting 80 that has been inserted to a proper position to achieve primary locking. The rear end edge of the rectangular tube portion 81 of the properly inserted terminal fitting 80 is located in the accommodation space 70.

Figure 9:
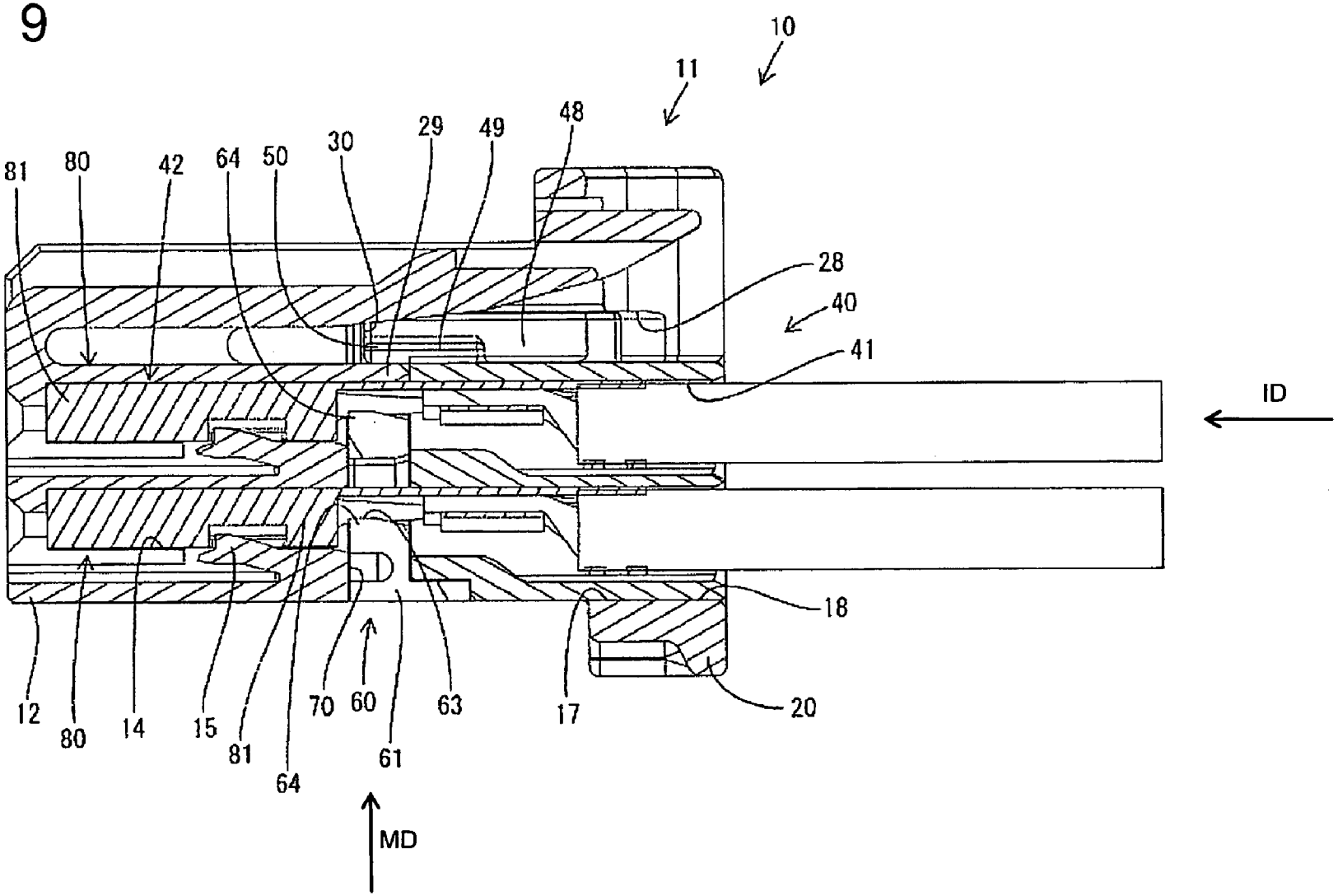
FIG. 9 is a longitudinal section showing the state where the retainer and the terminal fittings are mounted in the connector housing.
Figure 10:
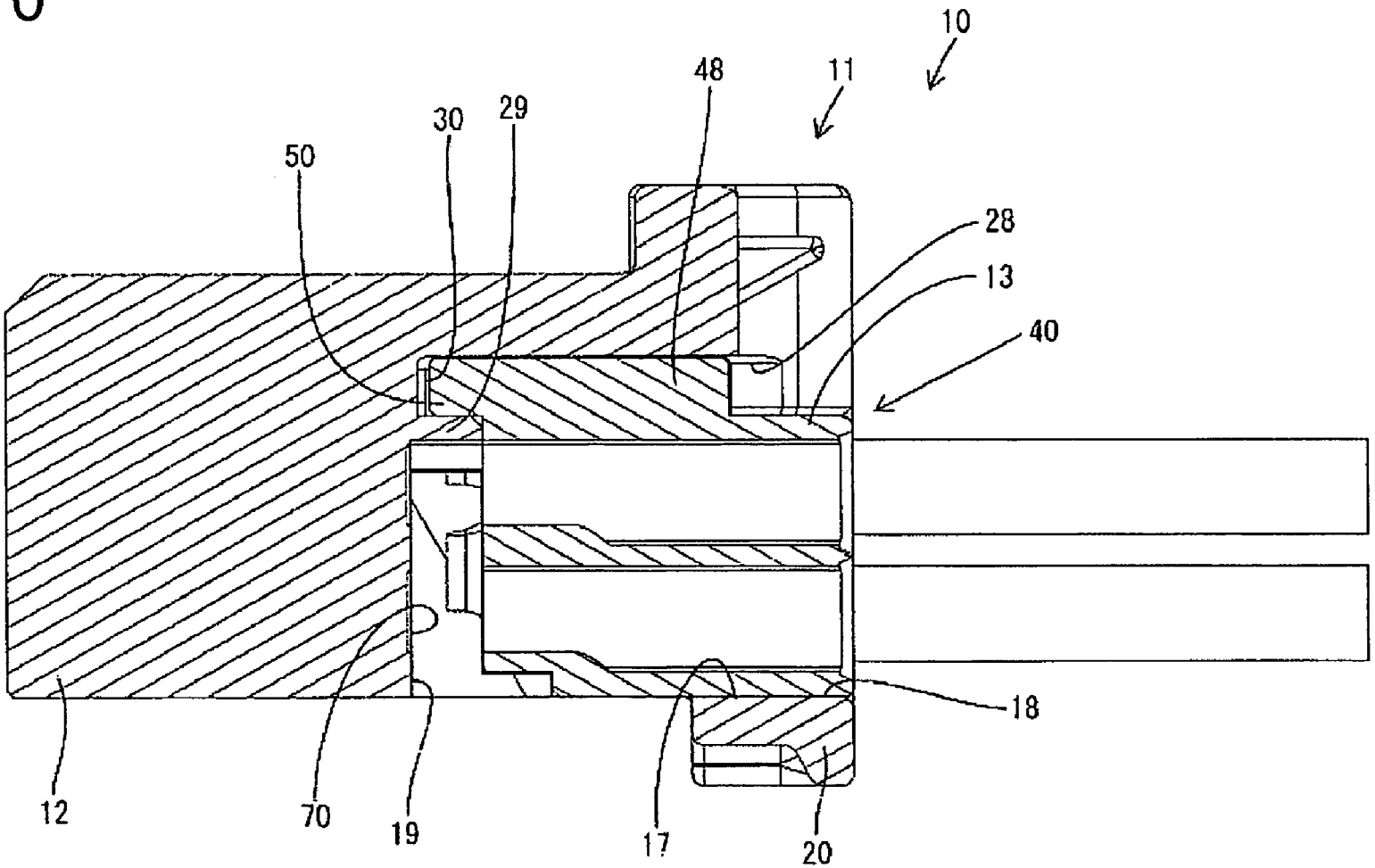
FIG. 10 is a longitudinal section showing a construction for preventing the inclination of the second housing.
Figure 11:
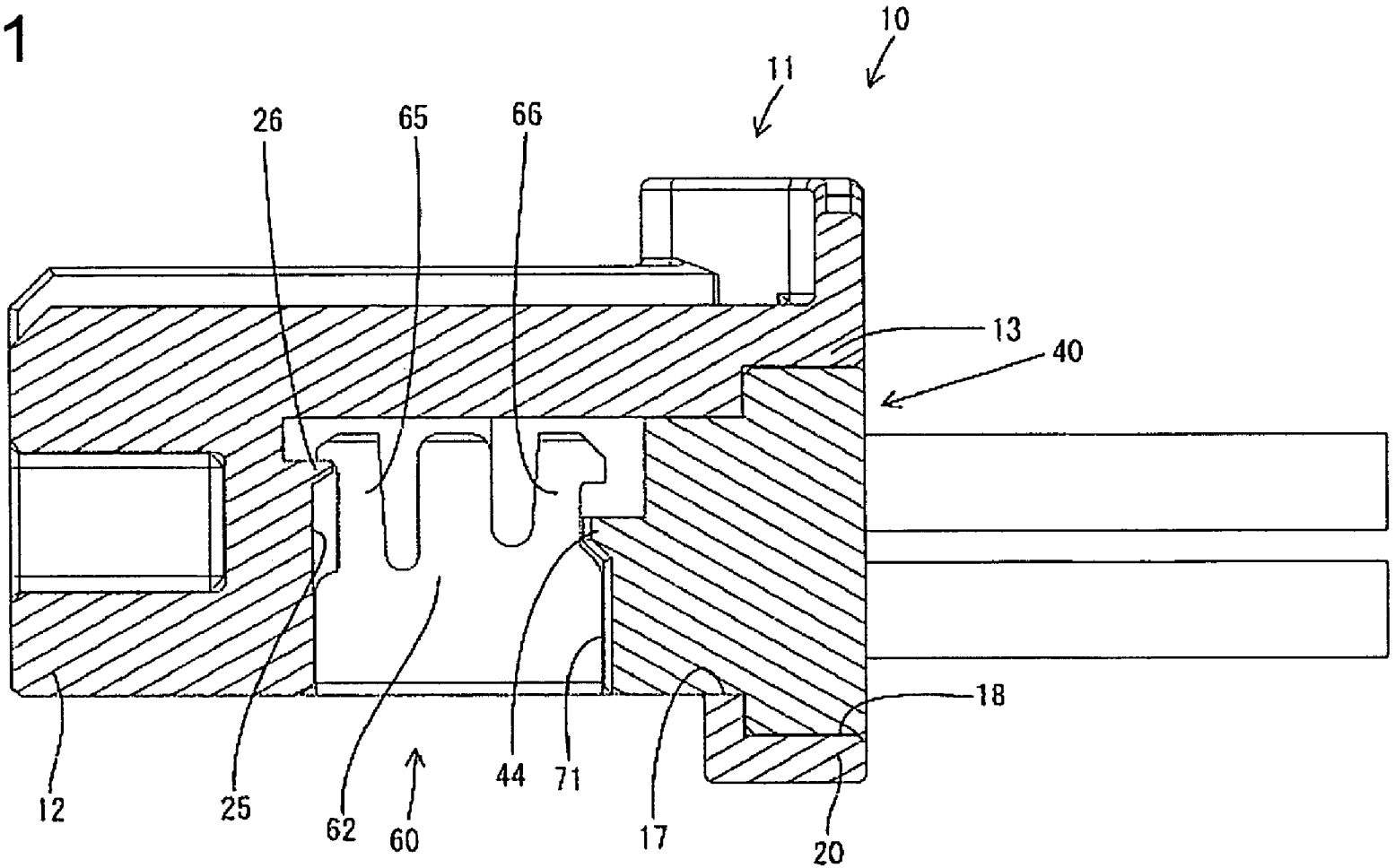
FIG. 11 is a longitudinal section showing locking means for holding the retainer at a full locking position.
Figure 12:
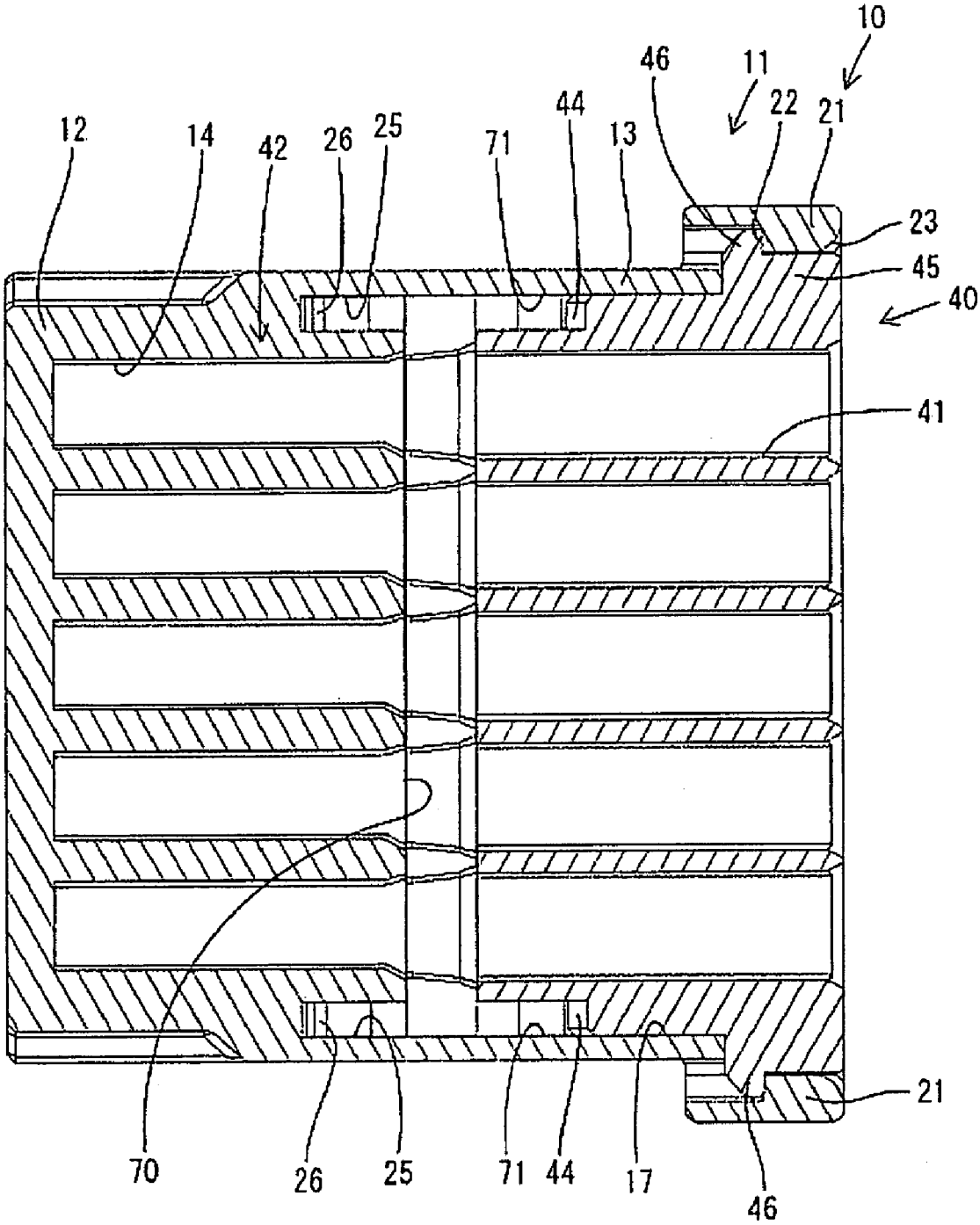
FIG. 12 is a horizontal section showing the state where the first housing and the second housing are assembled.
Figure 13:
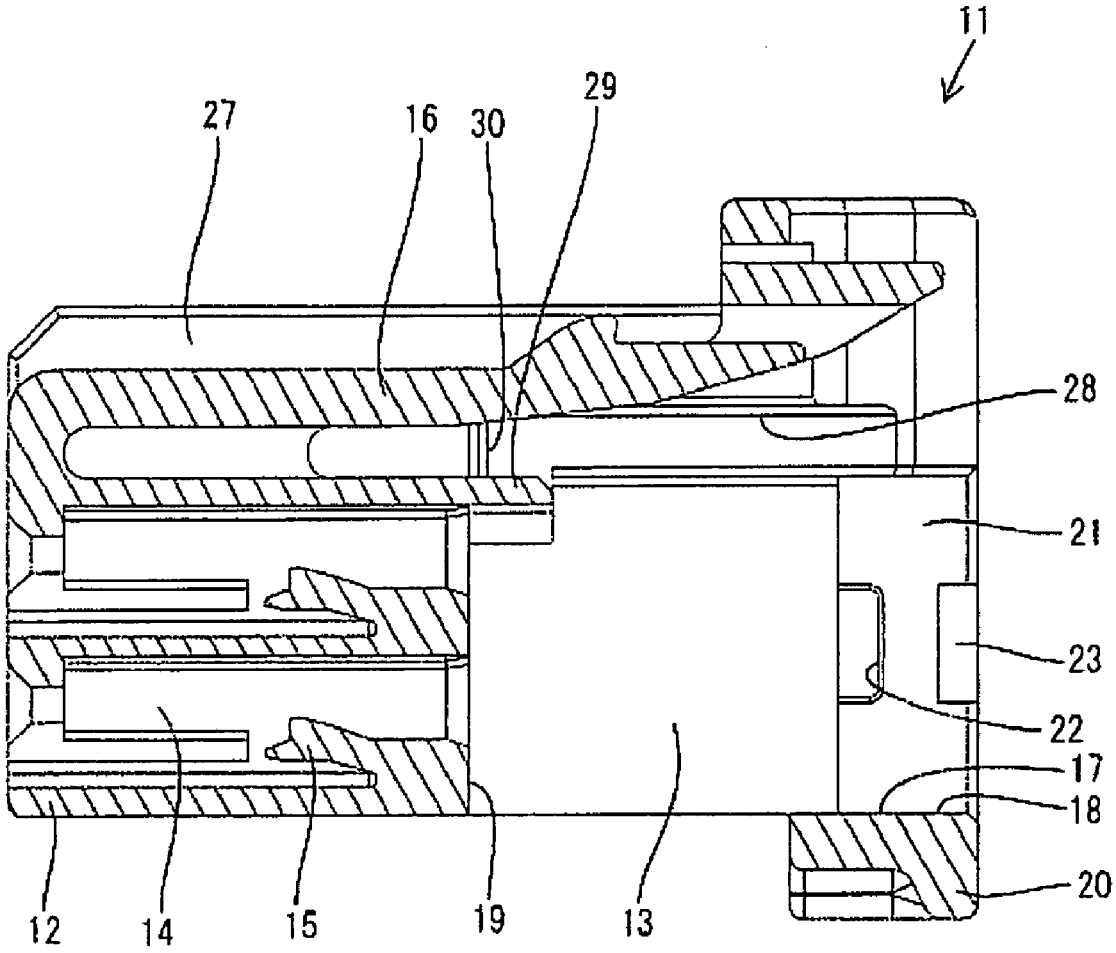
FIG. 13 is a longitudinal section of the first housing.
Figure 14:
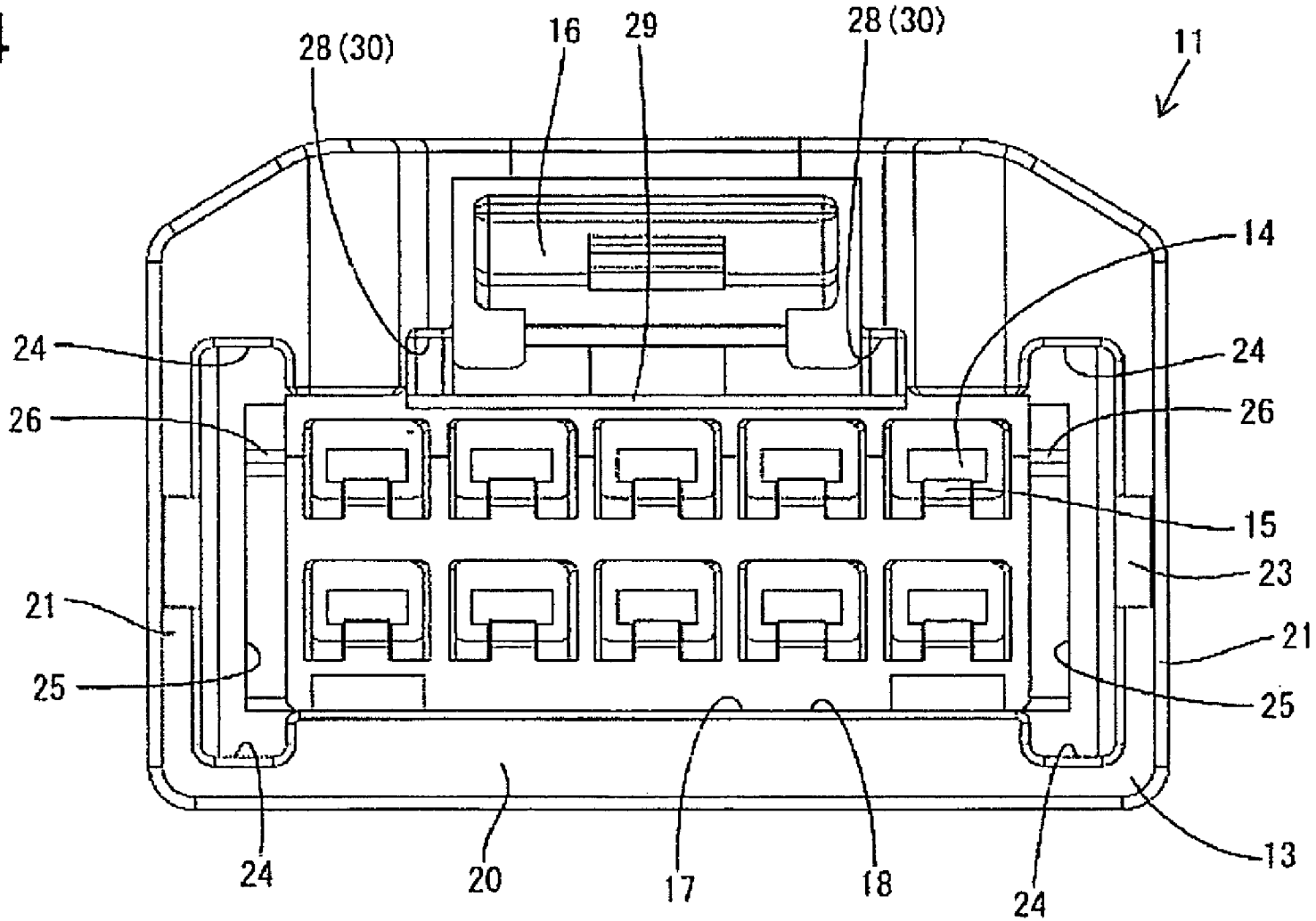
FIG. 14 is a rear view of the first housing.
Figure 15:
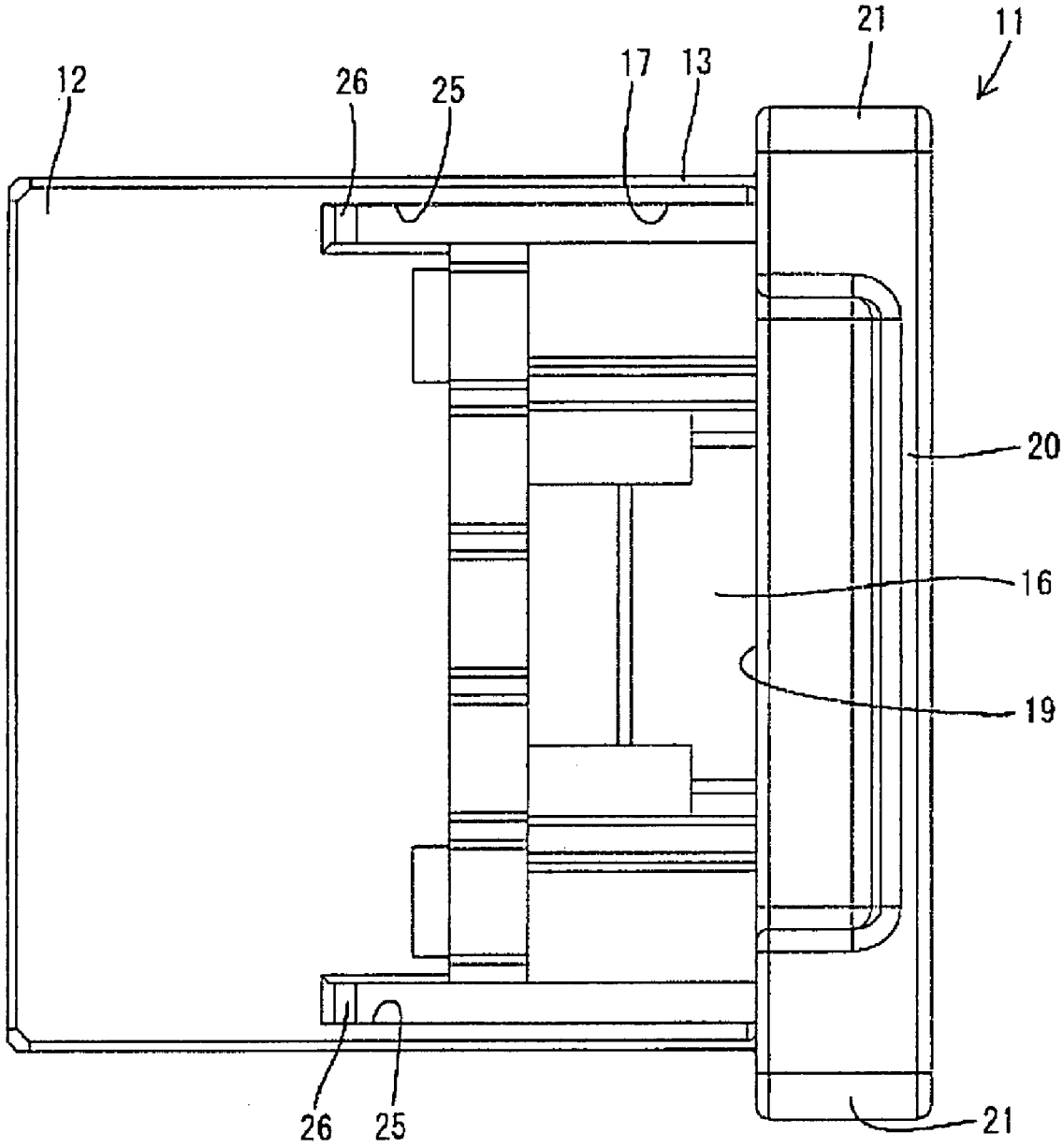
FIG. 15 is a bottom view of the first housing.
Figure 16:
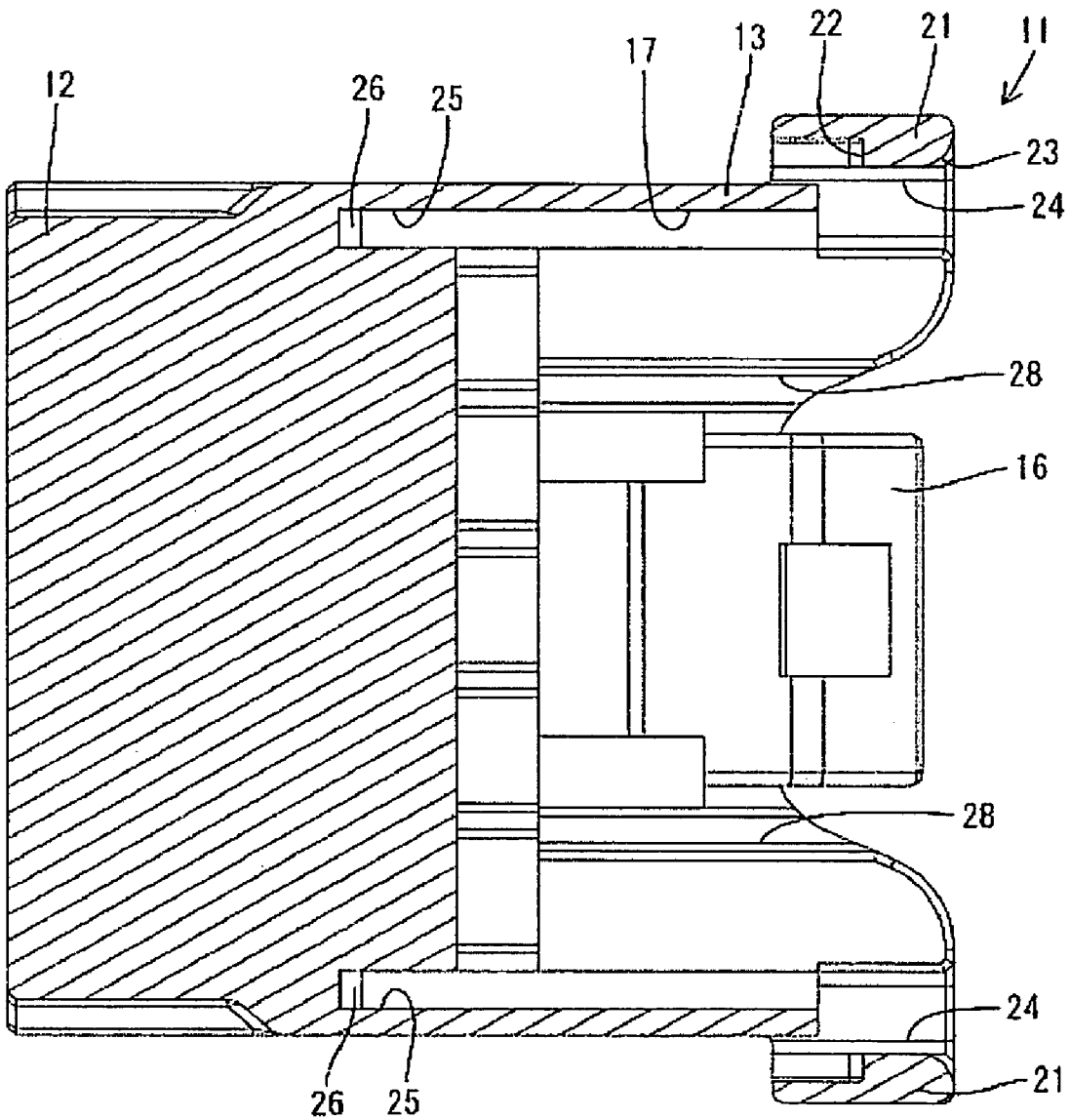
FIG. 16 is a horizontal section of the first housing.
Figure 17:
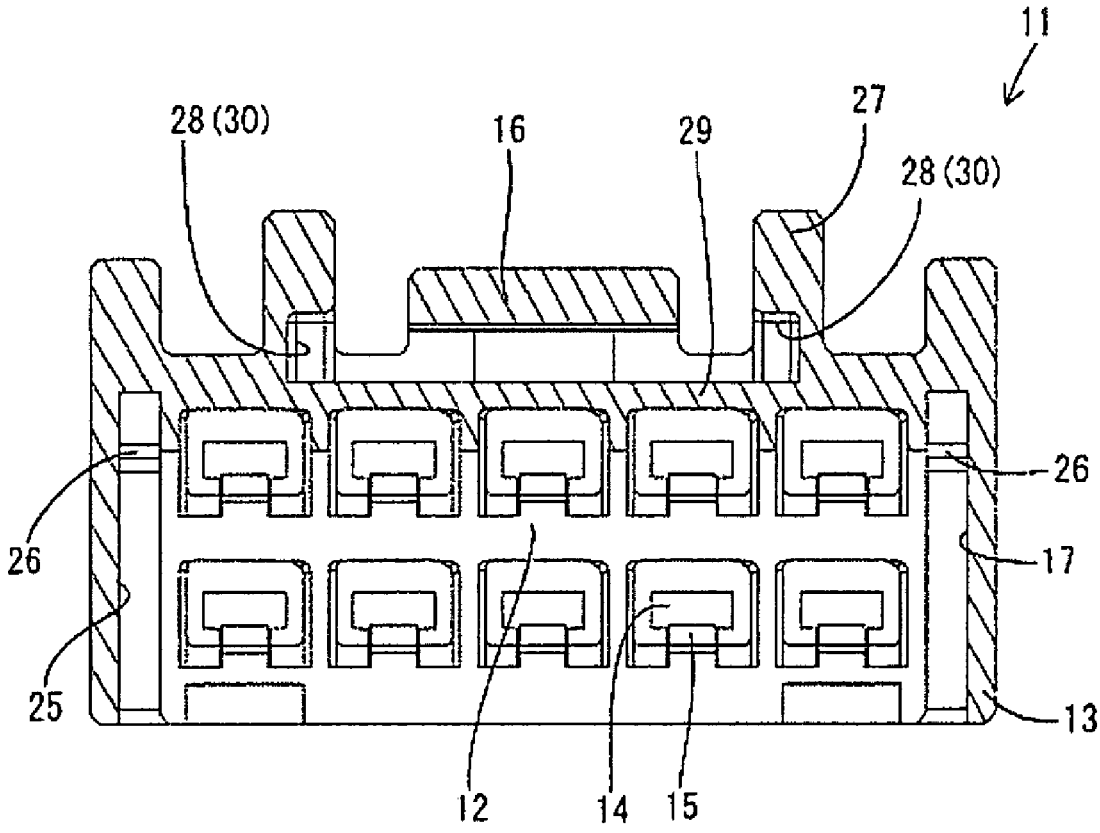
FIG. 17 is a transverse section of the first housing.
Figure 18:
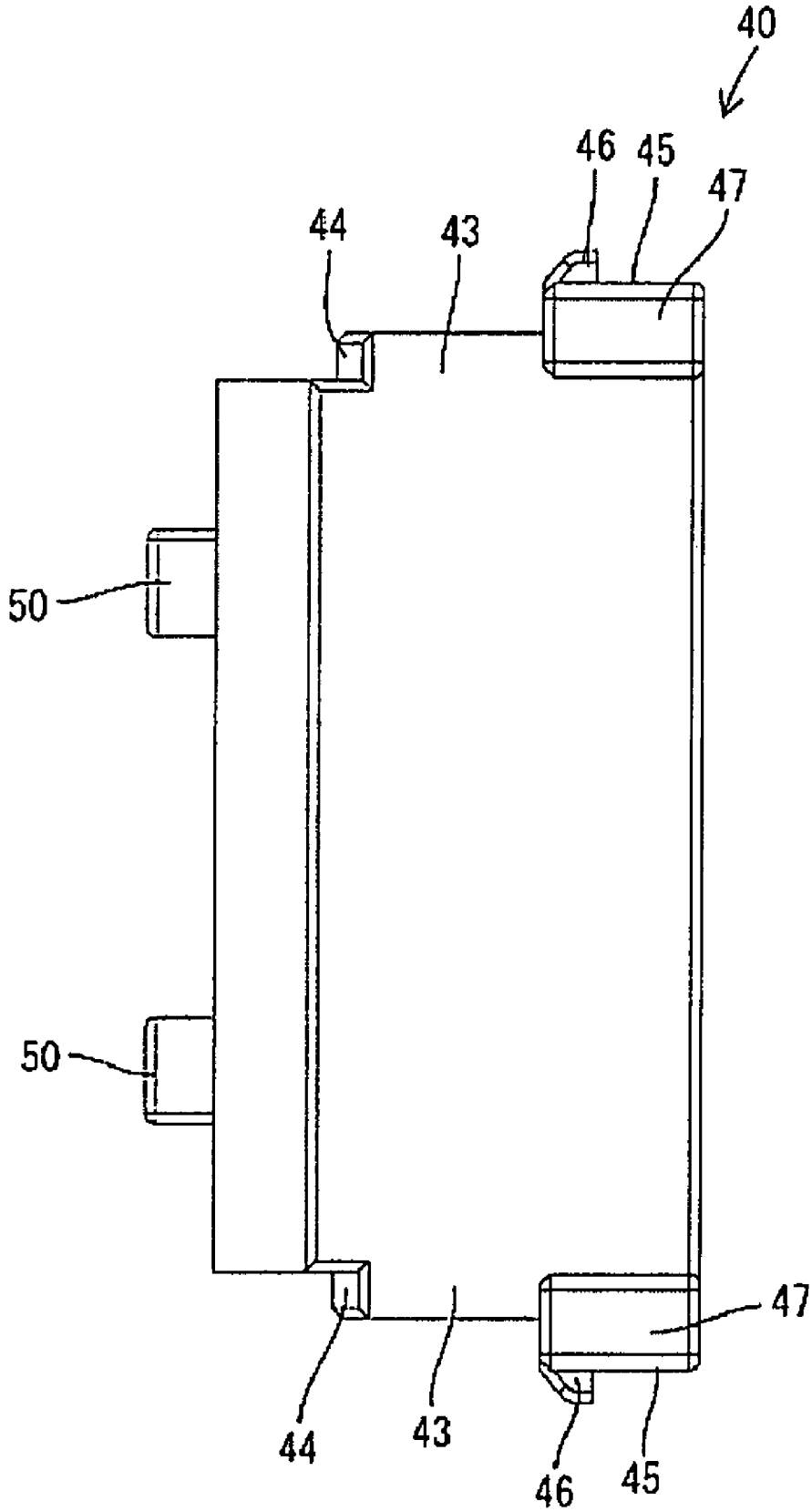
FIG. 18 is a bottom view of the second housing.

The retainer 60 is pushed in the mounting direction MD from the partial locking position to a full locking position after all the terminal fittings 80 are mounted. Then, as shown in FIG. 11, the claws at the leading ends of the resilient pieces 65 for full locking engage the full locking projections 26 from above to lock the retainer 60 at the full locking position. In this state, as shown in FIG. 9, the secondary locks 64 of the retainer 60 engage the rear ends of the rectangular tubes 81 of the terminal fitting 80 from behind, so that the terminal fittings 80 are locked secondarily to prevent backward withdrawing movements. In this way, the terminal fittings 80 are locked reliably and retained primarily by the locks 15 and the secondarily by the retainer 60.

As described above, the connector housing assembly 10 is formed by assembling the first housing 11 and second housing 40 individually formed by the molds that are opened in forward and backward directions FBD. The accommodation space 70 for accommodating the retainer 60 is defined between the first housing 11, located at the front end, and the second housing 40, located at the back end, as shown in FIGS.

3 and 9. Accordingly, it is sufficient for the molds for forming the connector housing 10 to include only the molds that are opened in forward and backward directions FBD to form the first and second housings 11 and 40. There is no need for a mold that is opened at an angle to the forward and backward directions FBD to form the accommodation space 70 for the retainer 60. Thus, the space necessary to open the molds for forming the housing assembly 10 is small.

Figure 3:
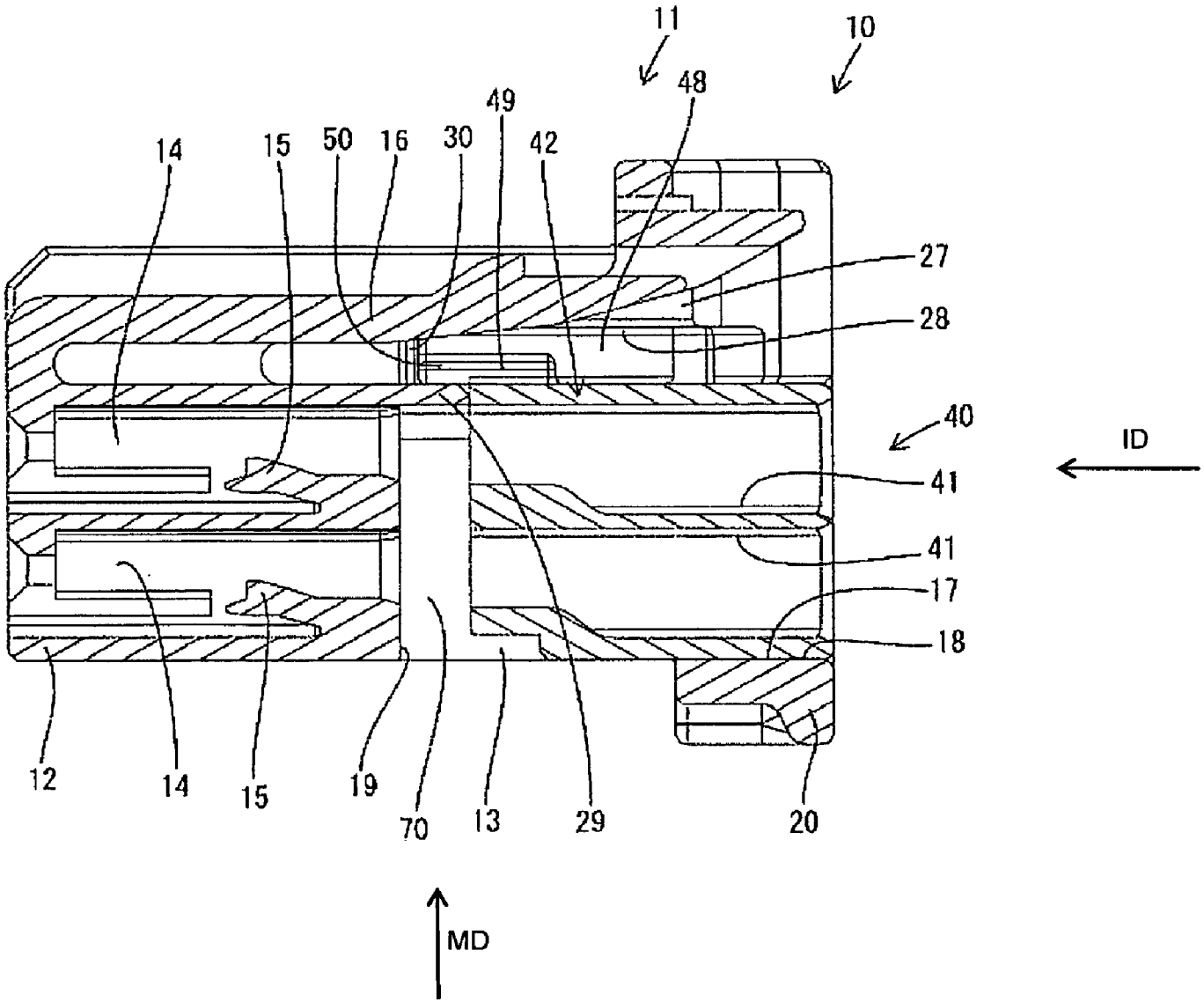
FIG. 3 is a longitudinal section showing a state where a first housing and a second housing are assembled.
Figure 4:
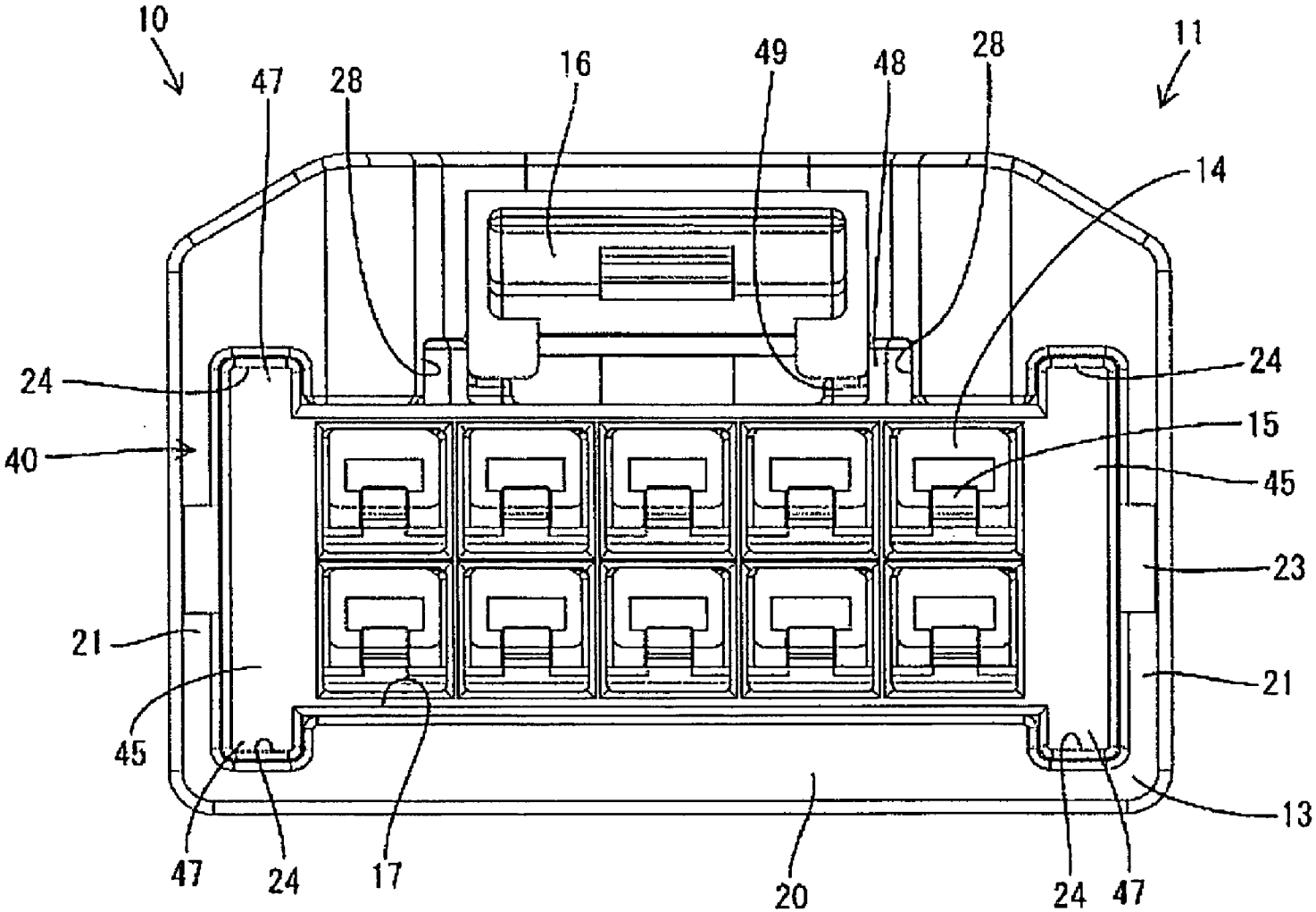
FIG. 4 is a rear view showing the state where the first housing and the second housing are assembled.
Figure 5:
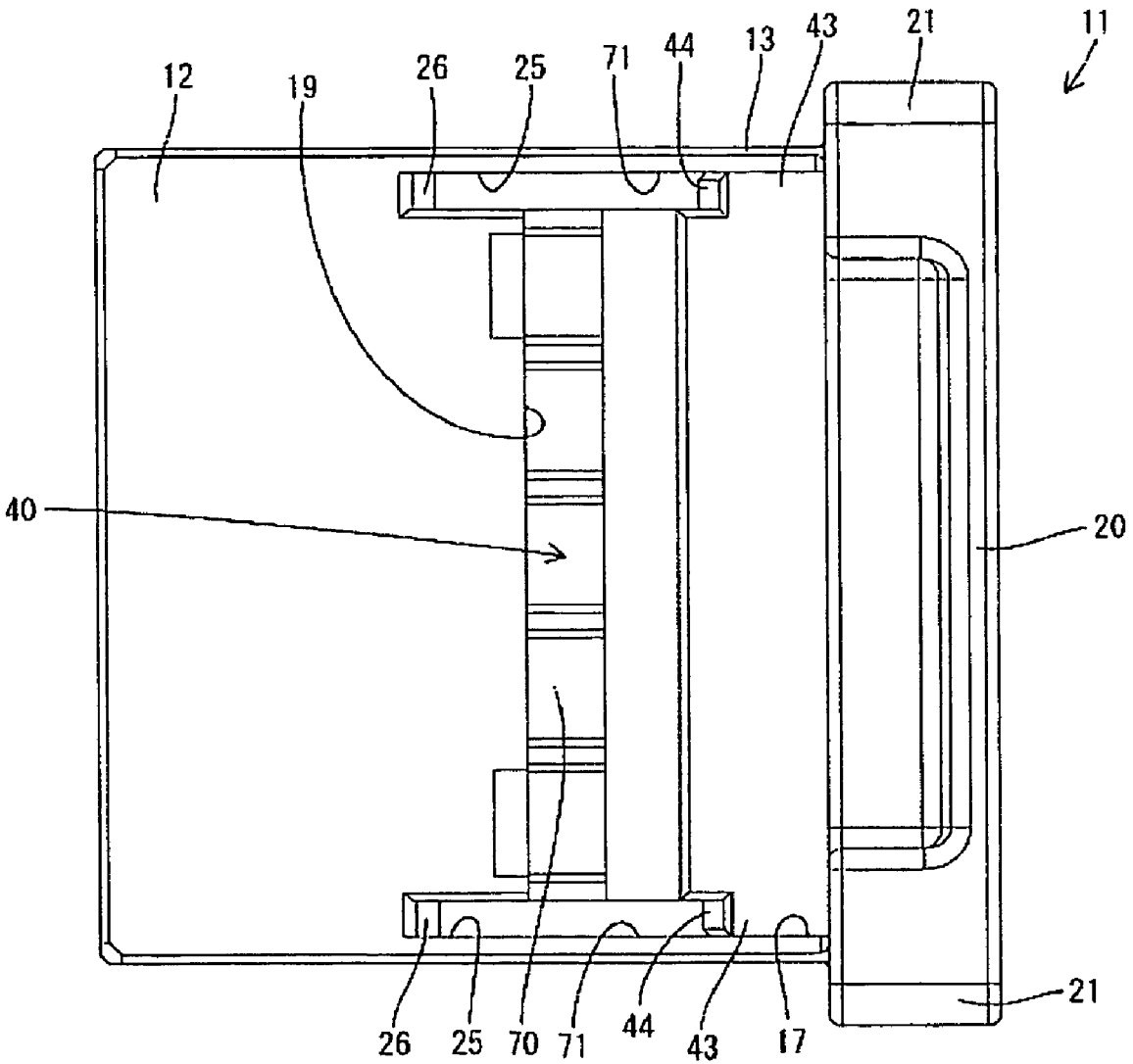
FIG. 5 is a bottom view showing the state where the first housing and the second housing are assembled.

Part of the second housing 40 is exposed at the retainer mount opening 19 when the second housing 40 is mounted in the accommodation recess 17. In such a case, the second housing 40 might be displaced towards the retainer mount opening 19. However, displacement of the front end of the second housing 40 towards the retainer mount opening 19 is prevented by the engagement of the locking projections 50 and the locking recesses 30, as shown in FIG. 3. The rear end of the second housing 40 is prevented from making vertical movements relative to the first housing 11. Thus, the second housing 40 is not displaced toward the retainer mount opening 19. The prevention of the inclination of the second housing 40 with respect to the first housing 11 assures that the centers of the front cavities 14 and those of the rear cavities 41 are not deviated in vertical direction and the terminal fittings 80 can be inserted into the cavities 42 without getting caught.

The invention is not limited to the above described and illustrated embodiment. For example, the following embodiments are also embraced by the technical scope of the present invention as defined by the claims.

The invention is also applicable to male connectors with male terminal fittings that have long narrow tabs at their leading ends.

The accommodation recess may be formed in the rear housing and may open forward.

The accommodation recess may not be formed in first housing and the second housing may not be accommodated into the second housing.

What is claimed is:

1. A connector, comprising:

a housing assembly made of a synthetic resin, at least one cavity penetrating the housing assembly in substantially forward and backward directions at least one terminal fitting insertable into the cavity in an inserting direction, and a retainer configured for mounting into the housing assembly in a mounting direction at an angle to the inserting direction of the terminal fitting, and retaining the terminal fitting in the cavity wherein:

the housing assembly includes first and second housings individually formed by molds that are opened in the forward and backward directions and being assembled together, the first housing having a rear end surface and the second housing having a front end surface, the front and rear end surfaces being opposed to one another and substantially parallel to the mounting direction of the retainer when the housings are assembled, and an accommodation space is defined between the front and rear end surfaces of the housings when the housings are assembled with each other the accommodation space being configured for receiving the retainer along the mounting direction.

2. The connector of claim 1, wherein the first housing is formed with at least one accommodation recess for at least partly accommodating the second housing and the retainer.

3. The connector of claim 2, wherein the accommodation recess includes an end opening formed in an end of the first housing and configured for accommodating the second housing and a retainer mount opening formed in an outer side surface at an angle to the end of the first housing an configured for accommodating the retainer.

4. The connector of claim 3, further comprising a finger placing portion in an area of the first housing between opening edges of the end opening and the retainer mount opening the flinger placing portion being configured for accommodating fingers of an operator.

5. The connector of claim 4, wherein an inner surface of the finger placing portion facing the end opening is substantially flush with a plane defined by extending the outer side surface formed with the retainer mount opening.

6. The connector of claim 2, wherein a part of the second housing is exposed at a retainer mount opening when the second housing is mounted in the accommodation recess.

7. The connector of claim 6, wherein at least one of the housings is formed with at least one lock for preventing displacement of the second housing towards the retainer mount opening.

8. A connector, comprising:

a first housing having a terminal accommodating portion with opposite first and second ends, at least one cavity extending through the terminal accommodating portion substantially along an inserting direction a receptacle projecting from the second end of the terminal accommodating portion the receptacle including an end opening that opens into the receptacle along the inserting direction and at a retainer mounting opening that opens into the receptacle at an angle to the inserting direction and at a position substantially adjacent the second end of the terminal accommodating portion a second housing with an end, the end of the second housing being insertable into the receptacle of the first housing through the end opening and along the inserting direction to a position where at least parts of the end of the second housing are spaced from the second end of the terminal accommodating portion of the first housing for defining an accommodation space and a retainer configured for mounting through the retainer mounting opening and into the accommodation space between the second end of the terminal accommodating portion of the first housing and the end of the second housing.

9. The connector of claim 8, wherein the first housing is made of a synthetic resin and is of unitary construction.

10. The connector of claim 9, wherein the second housing is made of a synthetic resin and is of unitary construction.

11. The connector of claim 10, wherein the terminal accommodating portion has an outer wall surface extending substantially parallel to the inserting direction from the first end of the terminal accommodating portion towards the second end thereof, the retainer mounting opening being substantially adjacent the outer wall surface.

12. The connector of claim 11, wherein the receptacle includes a finger placing wall disposed so that the retainer mounting opening is between the terminal accommodating portion and the finger placing wall the finger placing wall having an inner surface substantially coplanar with the outer wall surface of the terminal accommodating portion.

* * * * *